US008819958B2

(12) United States Patent
Bellinger et al.

(10) Patent No.: US 8,819,958 B2
(45) Date of Patent: Sep. 2, 2014

(54) END OF CYCLE DETECTION FOR A LAUNDRY TREATING APPLIANCE

(75) Inventors: Ryan R. Bellinger, Saint Joseph, MI (US); Christopher J. Woerdehoff, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 800 days.

(21) Appl. No.: 12/941,119

(22) Filed: Nov. 8, 2010

(65) Prior Publication Data

US 2012/0110869 A1 May 10, 2012

(51) Int. Cl.

| | |
|---|---|
| ***F26B 3/00*** | (2006.01) |
| ***F26B 21/00*** | (2006.01) |
| *D06F 58/28* | (2006.01) |

(52) U.S. Cl.

CPC ..... *D06F 58/28* (2013.01); *D06F 2058/2845* (2013.01); *D06F 2058/2861* (2013.01); *D06F 2058/2896* (2013.01); *D06F 2058/2841* (2013.01); *D06F 2058/2829* (2013.01)

USPC ..... 34/486; 34/524

(58) Field of Classification Search

USPC ..... 34/524, 445, 446, 491, 427, 486

See application file for complete search history.

(56) References Cited

U.S. PATENT DOCUMENTS

| | | | | | |
|---|---|---|---|---|---|
| 4,206,552 | A | * | 6/1980 | Pomerantz et al. | 34/445 |
| 5,276,978 | A | | 1/1994 | Hopkins et al. | |
| 5,651,192 | A | * | 7/1997 | Horwitz | 34/529 |
| 5,682,684 | A | * | 11/1997 | Wentzlaff et al. | 34/495 |
| 5,755,041 | A | | 5/1998 | Horwitz | |
| 6,401,357 | B1 | | 6/2002 | Smith et al. | |
| 6,784,997 | B2 | | 8/2004 | Lorenz et al. | |
| 2005/0086826 | A1 | | 4/2005 | Frushtick | |
| 2006/0260064 | A1 | | 11/2006 | Luckman et al. | |

FOREIGN PATENT DOCUMENTS

| | | | |
|---|---|---|---|
| EP | 0816551 | A2 | 1/1998 |
| EP | 0679754 | B1 | 9/1998 |
| EP | 1279760 | B1 | 11/2007 |
| FR | 2894996 | A1 | 6/2007 |
| JP | 5200194 | A | 8/1993 |
| JP | 6126099 | A | 5/1994 |
| JP | 2009078059 | A | 4/2009 |
| JP | 2009131786 | A | 6/2009 |
| WO | 2007/057360 | A1 | 5/2007 |

* cited by examiner

*Primary Examiner* — Kenneth Rinehart
*Assistant Examiner* — John McCormack

(57) ABSTRACT

A method of operating a laundry treating appliance having a rotatable treating chamber for receiving laundry to be dried according to a predetermined cycle of operation and determining when the laundry is dry.

27 Claims, 6 Drawing Sheets

END OF CYCLE DETECTION FOR A LAUNDRY TREATING APPLIANCE

BACKGROUND OF THE INVENTION

Laundry treating appliances, such as laundry dryers, may have means to detect an end of a cycle of operation with the use of various sensors, such as humidity sensors and temperature sensors. In the case of a drying cycle of operation, by making a quick detection when laundry is dry, energy consumption in the laundry dryer could be reduced. On the other hand, a false detection of an end of cycle may result in incomplete drying of clothes.

SUMMARY OF THE INVENTION

In one embodiment, the invention is related to a method of operating a laundry treating appliance having a rotatable treating chamber for receiving laundry to be dried according to a predetermined cycle of operation by supplying air into the treating chamber, heating the air as it is supplied into the treating chamber, and rotating the treating chamber to tumble the laundry within the treating chamber. Heated air is supplied into the treating chamber while the treating chamber is rotated to define a supply air flow and the heated air is exhausted from the treating chamber to define an exhaust air flow. The temperature of the laundry is determined to define a laundry temperature and the temperature of the exhaust air flow is determined to define an exhaust air temperature. A difference between the laundry temperature and the exhaust air temperature is determined, the difference is compared to a threshold, and the laundry is determined to be dry when the difference satisfies the threshold.

DESCRIPTION OF EMBODIMENTS OF THE INVENTION

This invention relates generally to the field of laundry treating devices and more particularly to a method of operating a laundry dryer to determine when laundry contained within the laundry dryer is dry, i.e. the laundry reaches a desired degree of dryness, which may be determined by the moisture content of the laundry.

Moisture sensors, such as conductivity hits sensors are commonly used to detect a dry laundry state, but may be ineffective in determining an end of cycle when the laundry is almost dry. Inlet and outlet air temperature sensors may also be used to determine if laundry is dry, but these methods may also have deficiencies related to inaccurate prediction of the end of cycle when the clothes load is small. The invention addresses the issue of inaccurate determination of when a laundry load is dry by using laundry temperature data.

Figure 1:
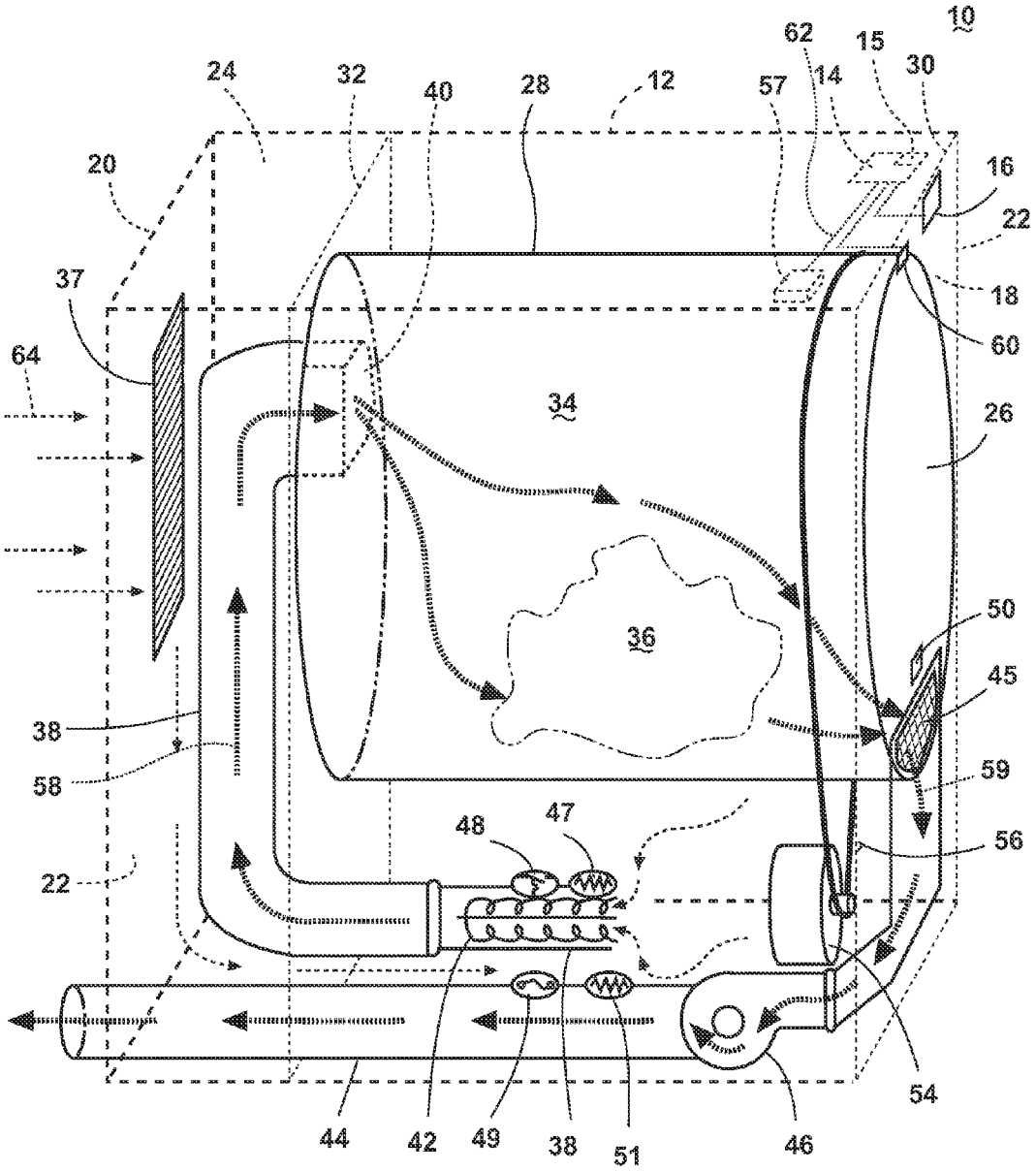
FIG. 1 is a schematic perspective view of a laundry treating appliance in the form of a clothes dryer that may execute an embodiment of the invention.

FIG. 1 is a schematic view of a laundry treating appliance in the form of a laundry dryer 10 according to a first embodiment of the invention. While the laundry treating appliance is illustrated as a laundry dryer 10, the laundry treating appliance according to the invention may be any appliance which performs a cycle of operation on laundry and has a drying phase during which air is heated to reduce the moisture in the laundry load, non-limiting examples of which include a horizontal or vertical axis clothes washer; a combination washing machine and dryer; a tumbling or stationary refreshing/revitalizing machine; an extractor; a non-aqueous washing apparatus; and a revitalizing machine. The laundry treating appliance according to the invention may also include both an open loop dryer and a closed loop dryer system, for example, a condensing, recirculating, or heat pump dryer. The laundry dryer 10 described herein shares many features of a traditional automatic clothes dryer, which will not be described in detail except as necessary for a complete understanding of the invention.

Any desired type of laundry may be dried. Examples of such laundry include, but are not limited to, a hat, a scarf, a glove, a sweater, a blouse, a shirt, a pair of shorts, a dress, a sock, a pair of pants, a shoe, an undergarment, and a jacket. Furthermore, textile fabrics in other products, such as draperies, sheets, towels, pillows, and stuffed fabric articles (e.g., toys), may be dried in the laundry dryer 10.

As illustrated in FIG. 1, the laundry dryer 10 may include a cabinet 12 which may be defined by a front wall 18, a rear wall 20, and a pair of side walls 22 supporting a top wall 24. A door 26 may be hingedly mounted to the front wall 18 and may be selectively movable between opened and closed positions to close an opening in the front wall 18, which provides access to the interior of the cabinet 12. A user interface 16 may be disposed on the front wall 18 of the laundry dryer 10. The user interface 16 may provide for a user to select or modify a predetermined cycle of operation of the laundry dryer.

A rotatable drum 28 may be disposed within the interior of the cabinet 12 between opposing stationary rear and front bulkheads 30, 32, which collectively define a treating chamber 34, for treating laundry 36, having an open face that may be selectively closed by the door 26. The drum 28 may include at least one lifter (not shown). In most dryers, there may be multiple lifters. The lifters may be located along the inner surface of the drum 28 defining an interior circumference of the drum 28. The lifters may facilitate movement of the laundry 36 within the drum 28 as the drum 28 rotates.

The drum 28 may be operably coupled with a motor 54 to selectively rotate the drum 28 during a drying cycle. The coupling of the motor 54 to the drum 28 may be direct or indirect. As illustrated, an indirect coupling may include a belt 56 coupling an output shaft of the motor 54 to a wheel/pulley on the drum 28. A direct coupling may include the output shaft of the motor 54 coupled to a hub of the drum 28.

A dispenser 57 may be provided to the laundry dryer 10 to dispense a treating chemistry during a drying cycle. As illustrated, the dispenser 57 may be located in the interior of the cabinet 12 such that the treating chemistry may be dispensed, although other locations are also possible. The dispenser 57 may include a reservoir (not shown) of treating chemistry that is releasably coupled to a dispenser 57, which dispenses the treating chemistry from the reservoir to the treating chamber 34. The treating chemistry may be any type of aid for treating laundry, and non-limiting examples include, but are not limited to fabric softeners, sanitizers, de-wrinklers, and chemicals for imparting desired properties to the laundry, including stain resistance, fragrance (e.g., perfumes), insect repellency, and UV protection.

An air system may be provided to the laundry dryer 10. The air system supplies air to the treating chamber 34 and exhausts air from the treating chamber 34. The supplied air may be heated or not. The air system may have an air supply portion that may form in part a supply conduit 38, which has one end open to ambient air 64 via a rear vent 37 and another end fluidly coupled to an inlet grill 40, which may be in fluid communication with the treating chamber 34. A heating element 42 may lie within the supply conduit 38 and may be operably coupled to and controlled by a controller 14. If the heating element 42 is turned on, supply air flow 58 is heated prior to entering the drum 28.

The air system may further include an air exhaust portion that may be formed in part by an exhaust conduit 44. A lint trap 45 may be provided as the inlet from the treating chamber 34 to the exhaust conduit 44. A blower 46 operably coupled to and controlled by the controller 14 may be fluidly coupled to the exhaust conduit 44. Operation of the blower 46 draws air into the treating chamber 34 as well as exhausts air as an exhaust air flow 59 from the treating chamber 34 through the exhaust conduit 44. The exhaust conduit 44 may be fluidly coupled with a household exhaust duct or exhausting the air from the treating chamber 34 to the outside the laundry dryer 10.

The air system may further include various sensor and other components, such as an inlet air temperature sensor 47 and a thermostat 48, which may be coupled to the supply conduit 38 in which the heating element 42 may be positioned. The inlet air temperature sensor 47 and the thermostat 48 may be operably coupled to each other. Alternatively, the inlet air temperature sensor 47 may be coupled to the supply conduit 38 at or near to the inlet grill 40. Regardless of its location, the inlet air temperature sensor 47 may be used to aid in determining the inlet air temperature. An outlet air temperature sensor 51 and thermal fuse 49 may be coupled to the exhaust conduit 44, with the exhaust air temperature sensor 51 being used to determine the outlet air temperature. A moisture sensor 50 may be positioned in the interior of the treating chamber 34 to monitor the amount of moisture of the laundry in the treating chamber 34. A laundry temperature sensor 60 may be positioned in the treating chamber 34 to monitor the temperature of the laundry.

The inlet air temperature sensor 47 and the outlet air temperature sensor 51 may be thermistor devices or any other known temperature sensing device. All objects with any thermal energy emit a black body radiation. For the laundry in the laundry treating appliance 10, the radiation may be in the infrared (IR) range. The laundry temperature sensor 60, therefore, may be an infrared (IR) sensor or any other known laundry temperature sensing devices. The IR sensor 60 may be positioned and oriented in a manner such that the IR sensor 60 may view the laundry contained within the treating chamber 34 and sense the IR radiation being emitted from the laundry. The temperature of the laundry may be determined from the peak frequency of the IR radiation emitted from the laundry or from the magnitude of the IR radiation emitted from the laundry. The IR sensor 60 may in particular sense wavelengths between 8 and 12 micrometers (μm), corresponding to a range of laundry temperatures between about 241° K and 362° K. When a peak wavelength is detected by the IR sensor 60, the corresponding temperature may be determined by applying Wien's Displacement Law. The laundry temperature sensor 60 may be a thermopile, a narrow gap semiconductor photodetector, a quantum well IR photodetector, or any other known types of laundry temperature sensors 60.

The various electronic components of the laundry dryer 10 including the user interface panel 16, the heating element 42, the inlet temperature sensor 47, the outlet temperature sensor 51, the humidity sensor 50, the motor 54, the blower 46, and the laundry temperature sensor 60 may be communicatively coupled to a controller 14 via electrical communication lines 62. The controller 14 may be a microprocessor, microcontroller, field programmable gate array (FPGA), application specific integrated circuit (ASIC), or any other known circuit for control of electronic components. The controller 14 may contain an electronic memory 15 for storing information from the various components.

The controller 14 may also store in its memory, the various cycles of operation in the form of executable instructions and corresponding data tables for controlling the operation of the various components to implement the various cycles of operation. During the implementation of the cycle of operation, the controller may receive various data as input from the various sensors and other components. In particular to the current invention, the laundry temperature and the exhaust air temperature data may be received and processed by the controller to determine an end of drying for the laundry load. It has been discovered that certain trends of the laundry temperature signal and the exhaust air temperature indicate when a laundry load is dry, especially for a predetermined load size. These trends may be more accurate than the data obtained with the traditional moisture sensor data.

Figure 2:
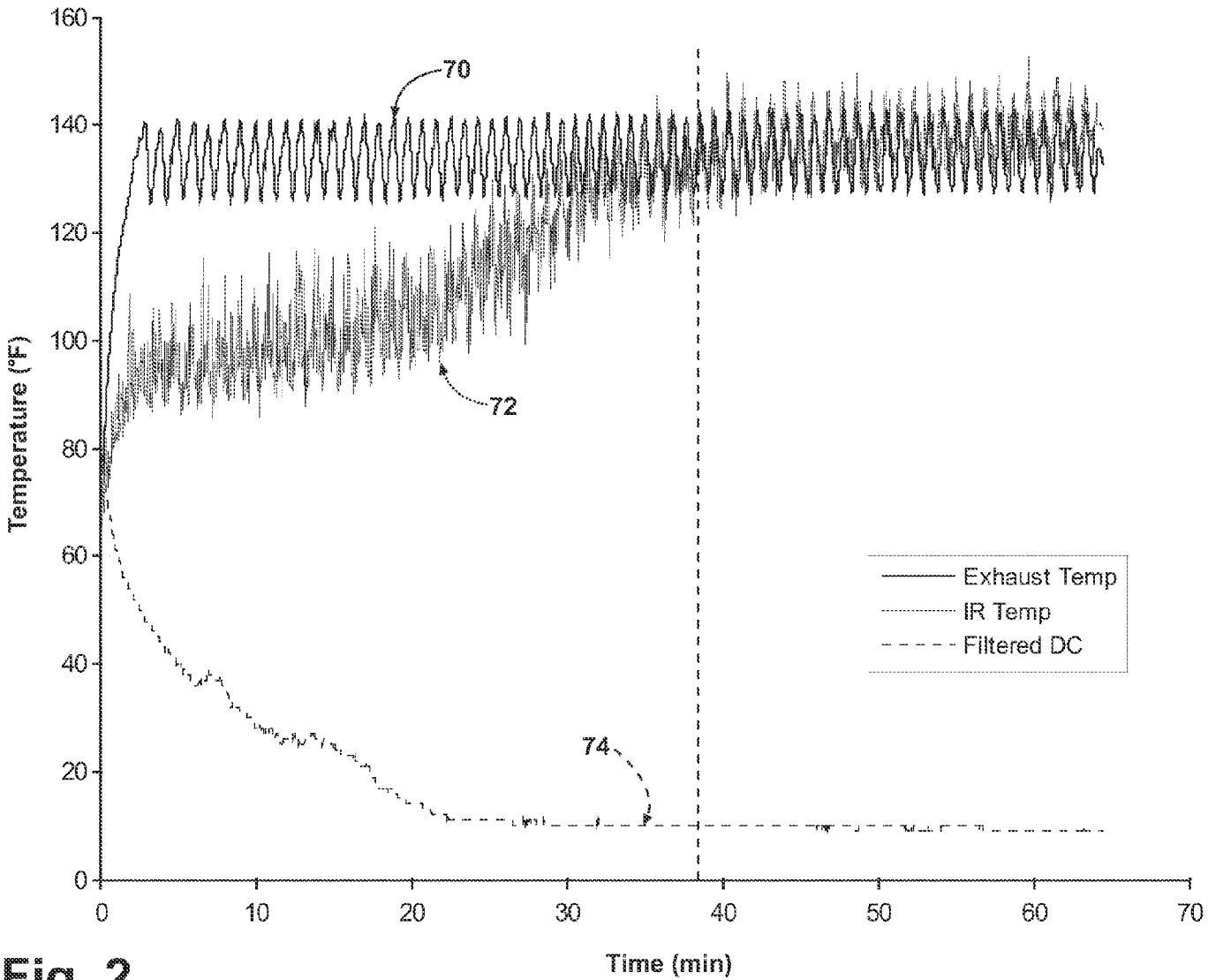
FIG. 2 is a graph of time series of exhaust air temperature, laundry temperature, and moisture sensor data for a medium sized laundry load.

FIG. 2 is a graph of such data in that it shows time series exhaust air temperature 70, laundry temperature 72, and filtered moisture sensor data 74 for a medium sized laundry load. Around a time of about 22 minutes into the drying cycle, the filtered moisture sensor data 74 is seen to approach a base where the filtered moisture sensor data 74 no longer varies with time. Therefore, beyond 22 minutes into the drying cycle of the laundry dryer 10, the moisture sensor data 74 no longer provides useful information about the dryness of the laundry load. However, the laundry temperature data 72 provides useful information about the temperature of the laundry throughout the whole drying cycle time. The temperature of the laundry is related to the moisture content, or the dryness of the laundry. In other words, during a significant portion of the overall drying cycle, the moisture sensor 50 fails to provide useful information related to the dryness of the laundry, while the laundry temperature sensor 60 does continue to provide useful information related to the dryness of the laundry.

The filtered moisture sensor data 74 is also referred to as wet hits data based on the conductivity of the laundry and is used commonly in current laundry dryers to determine the point in time where laundry within the laundry dryer 10 is dry. However, filtered moisture sensor data 74 has several deficiencies including susceptibility to electromagnetic interference (EMI), such as 60 Hz line noise, switching noise, and electrostatic discharge (ESD) noise. Moisture sensor signals 74 also exhibit high levels of variability based on the wetness of the laundry, type of laundry, and the laundry material. For example, as shown in FIG. 2 the moisture sensor data 74 may not generate useful information when the moisture content of the laundry drops below approximately 20%. Additionally, the moisture sensor data 74 may not be helpful in determining end of cycle and dryness when the laundry contains synthetic cloth with low electrical conductivity, such as nylon or polyester. When drying laundry with bulky items, such as duvets or comforters, the moisture sensor 50 may again be ineffective in producing useful moisture sensor data 74, because the outside of the laundry that contacts the moisture sensor 50 may dry, but the insides may still have moisture that is not detected by the moisture sensor 50.

For the medium load, the laundry temperature 72 is initially substantially lower than the exhaust air temperature 70 and converges toward the exhaust air temperature 70 while the laundry is wet. When the laundry 36 is dry or near dry, the laundry temperature 72 may rise to the exhaust air temperature 70 as indicated by the dotted line at about 38 minutes in to the drying cycle. This dry declaration point may be 15 minutes or more after the filtered moisture sensor data 74 no longer provides any useful information. If the laundry is allowed to continue to dry beyond the dry declaration point, then the laundry temperature 72 may rise above and diverge from the exhaust air temperature 70.

The oscillatory nature, or the sinusoidal variation, of both the exhaust air temperature 70 and laundry temperature 72 may be a result of the way the heating element 42 is controlled by the controller 14. The heating element 42 is typically energized and de-energized by the controller based upon the exhaust air temperature 70 measurement to maintain the exhaust air temperature 70 within a predefined range. In other words, when the exhaust air temperature 70 reaches an upper limit of the predefined range, the heating element 42 is de-energized by the controller 14 to effect a decrease in both the laundry temperature 72 and the exhaust air temperature 70. Similarly, when the exhaust air temperature 70 reaches a lower limit of the predefined range, the heating element 42 is re-energized by the controller 14 to effect an increase in both the laundry temperature 72 and the exhaust air temperature 70. The repeated energizing and de-energizing of the heating element 42 results in the oscillatory temperature measurements 70 and 72.

The relative behavior of the exhaust air temperature 70 and the laundry temperature 72 may be explained by considering the phenomena of blow-by air, the heat capacity of water, and evaporative cooling of the wet laundry 36. The heating element 42 heats the supply air flow 58 within the inlet conduit 38, prior to entering the treating chamber 34. Some of the heated supply air flow 58 entering the treating chamber 34 interacts with the laundry 36 contained therein to transfer thermal energy, or heat, to the laundry before exhausting from the treating chamber 34 as exhaust air flow 59. The transfer of thermal energy may be by conductive heating as the heated supply air flow 58 heats up the drum 28, which in turn heats up the laundry that comes in contact with the drum 28. The laundry may further be heated by convection heating via the heated supply air flow 58 contacting the laundry and transferring thermal energy. The laundry 36 may also be heated by radiative heating as the heated inlet air 58 may radiate thermal energy, some of which may be absorbed by the laundry.

For a medium size laundry load, some amount of the heated supply air flow 58 may blow through the treating chamber 34 and exhaust as exhaust air flow 59 without transferring thermal energy to the laundry 36 contained within the treating chamber 34. This air may be referred to as blow-by air, as it blows by without significantly interacting with or transferring thermal energy to the laundry 36 or the drum 28. This blow-by air is approximately the same temperature as the heated supply air, as the blow-by air does not lose significant amounts of thermal energy. For a medium size load, there is some amount of blow-by air in the exhaust air flow 59 and therefore the exhaust air flow 59 has a higher exhaust air temperature 70 than the laundry temperature for a wet medium sized laundry load 36. At the same time, the wet load of laundry 36 may stay cold relative to the exhaust air flow 59 due to both evaporative cooling of the laundry 36 and high heat capacity, or high specific heat of the water contained in the wet laundry 36. As a result, while the laundry is wet, the laundry temperature 72 may be is less than the exhaust air temperature 70 for a medium size load.

As the medium load laundry 36 dries, there may be several phenomena that cause the laundry temperature 72 to converge with the exhaust air temperature 70. As the moisture content in the laundry decreases, there may be reduced evaporative cooling of the laundry 36 compared to when the laundry 36 is wet. Additionally, the wet laundry 36 is a composite of fabric and water and as the moisture, or water content, of the laundry reduces, the effective specific heat of the laundry also reduces. This is because the heat capacity of water is greater than fabric. In other words, as the laundry 36 dries, less energy is required to effect a change in the laundry temperature 72. Finally, as the laundry 36 dries, it may have a tendency to not clump or ball up as much as wet laundry. Instead dryer laundry 36 may have an increased surface area relative to wet laundry, thereby increasing its interaction with the supply air flow 58 and thereby reducing the blow-by air.

Additionally, the fabric type of the laundry 36 may also affect the relative behavior of the exhaust air temperature 70 and the laundry temperature 72. Different fabric types, such as different materials, weaves, thread counts, density, treatments/coatings may allow a different levels of evaporation of moisture. For example, towels may allow greater levels of evaporation than jeans. The evaporation rates of the laundry 36 may influence the relative magnitude and relative trend of the exhaust air temperature 70 and the laundry temperature 72.

Figure 3:
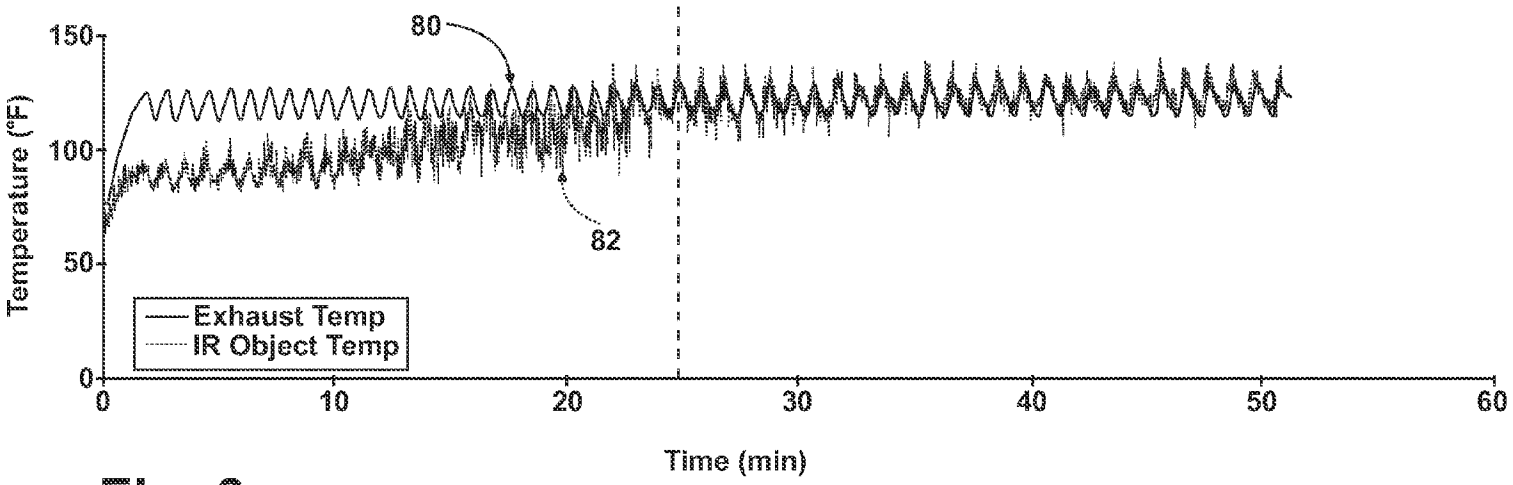
FIG. 3 is a graph of time series exhaust air temperature and laundry temperature for a small size laundry load.

FIG. 3 is a graph of time series exhaust air temperature 80 measured by the outlet air temperature sensor 51 and laundry temperature 82 measured by a laundry temperature sensor 60 for a small size laundry load such as 2 pounds of business casual clothes. Initially, the laundry temperature 82 is much less than the exhaust air temperature 80, such as between time 0 and about 23 minutes into the drying cycle. For example the difference in temperature may be approximately 30° F. During this time, the laundry temperature 82 generally increases with time and converges toward the air outlet temperature 80 as the laundry 36 contained within the drying chamber 34 continues to dry. Around the time of 23 minutes into the drying cycle, the laundry temperature 82 and the air outlet temperature 80 are at approaching the same level. Beyond about 25 minutes into the drying cycle, the laundry temperature 82 and the air outlet temperature 80 are at approximately the same level. In other words, for a small laundry 36 load in the laundry dryer 10, there may be an initial period of time where the laundry temperature 82 may be less than the exhaust air temperature 80, followed by a second period of time where the laundry temperature 82 and the exhaust air temperature 80 are approximately the same. Additionally, the moisture content of the laundry load in the initial period of time may be greater than the moisture content in the laundry load during the second period of time. The laundry 36 may be considered dry when the laundry temperature 82 rises to the exhaust air temperature 80. For example, the laundry 36 may be considered dry when the difference between the laundry temperature 82 and the exhaust air temperature 80 is 0° F. or greater as indicated by the dotted line at about 25 minutes in to the drying cycle.

For a small and wet laundry load, there may be a greater amount of blow-by air compared to a larger size load, as there is less laundry surface area with which the heated supply air flow 58 can interact and transfer thermal energy to the laundry 36 or the drum 28. As a result, while the laundry is wet, the there may be a greater difference between the exhaust air temperature 80 and the laundry temperature 82 for a small load as compared to a larger load. When the laundry is considered dry or near-dry, the laundry temperature 82 may rise to or above the exhaust air temperature 80. This may happen because the exhaust air temperature 80 may be determined by the exhaust air temperature sensor 51 downstream of the treating chamber 34, such as in the exhaust conduit 44. As a result, the air that may have been at the same temperature as the laundry within the treating chamber may lose some thermal energy as it travels through the exhaust conduit 44, resulting in a lower temperature measured at the exhaust air temperature sensor 51.

Figure 4:
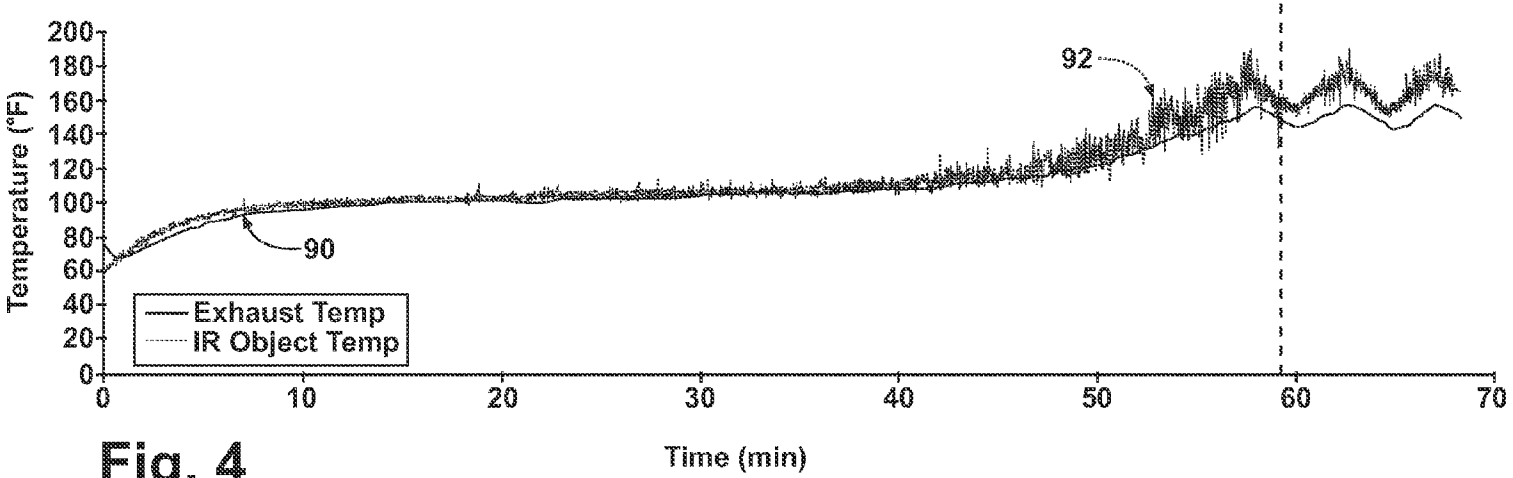
FIG. 4 is a graph of time series exhaust air temperature and laundry temperature for a large size laundry load.

FIG. 4 is a graph of time series exhaust air temperature 90 as measured by the outlet air temperature sensor 51 and laundry temperature 92 as measured by the laundry temperature sensor 60 for a large size laundry load, such as a 15 pound load of towels. Unlike the small load of FIG. 3, the large load may have an outlet air temperature 90 and laundry temperature 92 that are close to each other, such as within 5 degrees F. with the laundry temperature 92 greater than the air outlet temperature 90. With a large load size, there may be relatively less blow-by air compared to the small load case of FIG. 4. That means that more of the heated supply air flow 58 interacts with the laundry 36 contained within the treating chamber 34 before exhausting from the treating chamber as exhaust air flow 59. As a result, the larger load laundry 36 may be more effective in extracting thermal energy from the airflow through the treating chamber 34. As the air flow drops in temperature during its flow through the treating chamber 34, a lower temperature of the exhaust air flow 59 may be detected by the exhaust air temperature sensor 51. Therefore, the laundry temperature 92 may be similar in magnitude to the exhaust air temperature 90.

When the large laundry load dries, the laundry temperature 92 may exceed and diverge from the exhaust air temperature 90. Unlike the small laundry load, the large laundry temperature does not initially begin substantially below the exhaust air temperature. Instead, the laundry temperature corresponds with exhaust air temperature until the divergence. Therefore, there may be an initial time period when the laundry temperature 92 corresponds with the exhaust air temperature and does not diverge from each other. There may be a second time period when the laundry temperature 92 increases and diverges from the exhaust air temperature 90. The relative behavior and relative magnitude of the laundry temperature 92 and the exhaust air temperature 90 may be indicative of the moisture content of the laundry 36. In the case of the large load the laundry may be considered dry when the laundry temperature 92 exceeds the exhaust air temperature 90 by a threshold value. For example, the threshold value may be 15° as indicated by the dotted line at about 58 minutes in to the drying cycle.

In the method as disclosed herein, the relative magnitude of the laundry temperature and the exhaust air temperature is used to determine if a load of laundry 36 is dry in the treating chamber 34. In one aspect, the difference between the laundry temperature and the exhaust air temperature is compared to a threshold value to determine if the laundry is dry. As seen in FIGS. 2-4, the initial and final relative magnitudes of the laundry temperature and the exhaust air temperature, and therefore the difference between them may vary depend on the size of the laundry load. Therefore, the initial relative magnitude of the two temperature measurements may be used to determine the threshold value. Additionally, the relative behavior (i.e. correspondence or divergence) of the two temperature signals may be used to distinguish between a small, medium and large load sizes if that determination is not otherwise made in any of the traditional manners such as by motor torque. As the relative behavior may be used to determine load size, it may not be necessary for the implementation of the invention that the load size be known prior to determining when a load is dry. This makes it possible to eliminate any special sensors used for determining load size. Alternatively, the threshold for comparison of the difference of the two temperature measurements may be determined based upon the load size of the laundry 36 in the treating chamber 34 by any known means.

Figure 5:
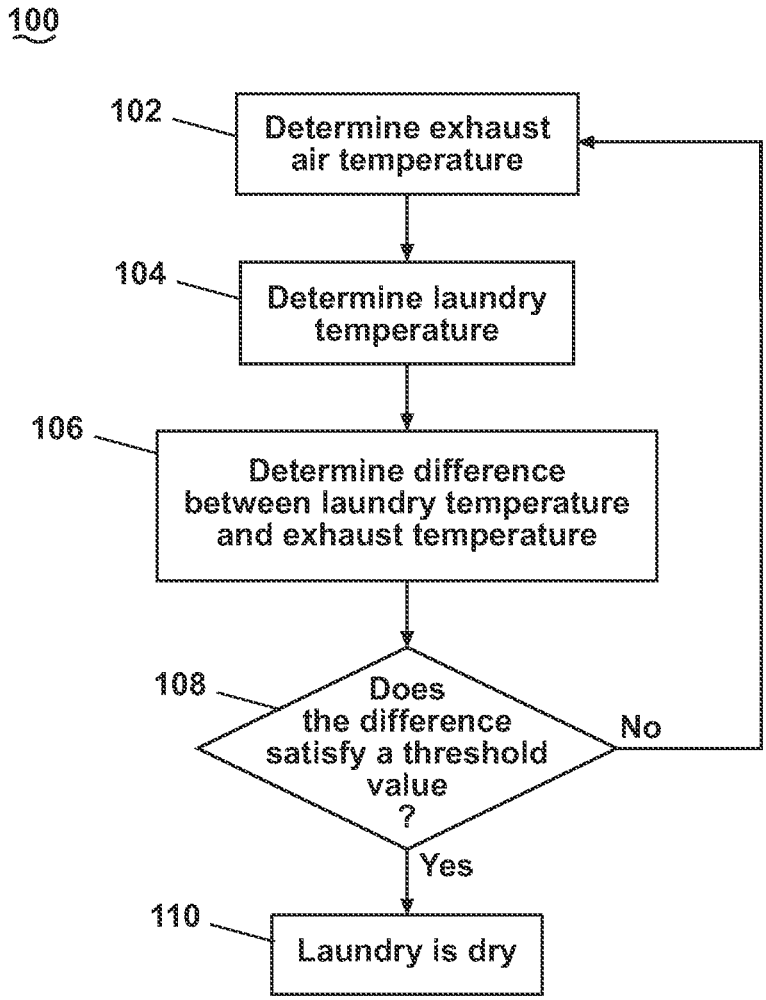
FIG. 5 is a flow diagram of the method of determining if a laundry load is dry according to an embodiment of the current invention.

FIG. 5 is a flow diagram of the method of determining if a laundry load is dry 100 by exploiting the phenomena discussed in conjunction with FIGS. 2-4. First, the exhaust air temperature is determined at 102 using the exhaust air temperature sensor 51 within the exhaust air flow conduit 44. Next, the laundry temperature is determined at 104 using the laundry temperature sensor 60 located within the treatment chamber 34. The difference between the laundry temperature and exhaust temperature is determined at 106 by the controller 14. The difference in the two temperature measurements is compared to a threshold value at 108 by the controller 14. If the difference is found to satisfy the threshold value, then the laundry 36 is declared dry at 110. If the threshold value is not satisfied, then the method loops back to determining the exhaust air temperature at the next sampling time at 102.

The sequence of steps depicted is for illustrative purposes only, and is not meant to limit the method 100 in any way as it is understood that the steps may proceed in a different logical or sequential order and different, additional, overlapping, or intervening steps may be included without detracting from the invention.

In one aspect, the threshold value may be satisfied at 108 when the difference is greater than the threshold value. This means that when the laundry temperature minus the exhaust air temperature at any particular point in time is greater than the threshold value, the load may be considered dry. Alternatively, the threshold value may be satisfied at 108 when the difference is less than the threshold value.

In another aspect, the controller 14 may save a time series of the difference data in the electronic memory 15. Such data may be saved to determine a moving average of the difference data to filter out the fluctuations in the difference data primarily resulting form the fluctuations in the laundry temperature measurements. Such a moving average or any other mathematical smoothing operation may be used for the purpose of filtering out the fluctuations in the difference data for comparison to the threshold value.

In yet another aspect, the controller 14 may save a time series of the laundry temperature data and the exhaust air temperature data in the electronic memory 15. The two time series temperature data sets saved in the electronic memory 15 may be used to implement a phase shift, or a relative time shift when calculating the difference in the difference between the two temperature measurements. This may be done to get a difference based upon points in the both time series data that correspond to each other. Any given sampling at a point in time may not produce data points in the two time series data that correspond if the exhaust air flow temperature is sampled much further downstream than the laundry temperature.

As discussed in conjunction with FIGS. 2-4, the threshold value for comparing the difference depends on the laundry 36 load size. It is also apparent from the same FIGS. 2-4 that the difference between the laundry temperature and the exhaust air temperature is different for different load sizes near the beginning of the laundry drying cycle. Therefore, it may be possible to determine a qualitative load size by comparing the laundry temperature and the exhaust air temperature during the first few minutes of the drying cycle and comparing the same to a limit value. For example, if the difference between the laundry temperature and the exhaust air temperature is greater than 20° F. after the first 5 minutes of the drying cycle, then the laundry load size may be determined as small. Similarly, a temperature difference greater than 10° F. during the first few minutes may indicate a medium sized load. Finally, a temperature difference at or less than 0° F., meaning the laundry temperature is at or greater than the exhaust air temperature, may indicate a large sized load. As a result, the difference in the two temperatures near the start of the drying cycle may be used to determine the threshold value required for determining that the laundry is dry.

Figure 6:
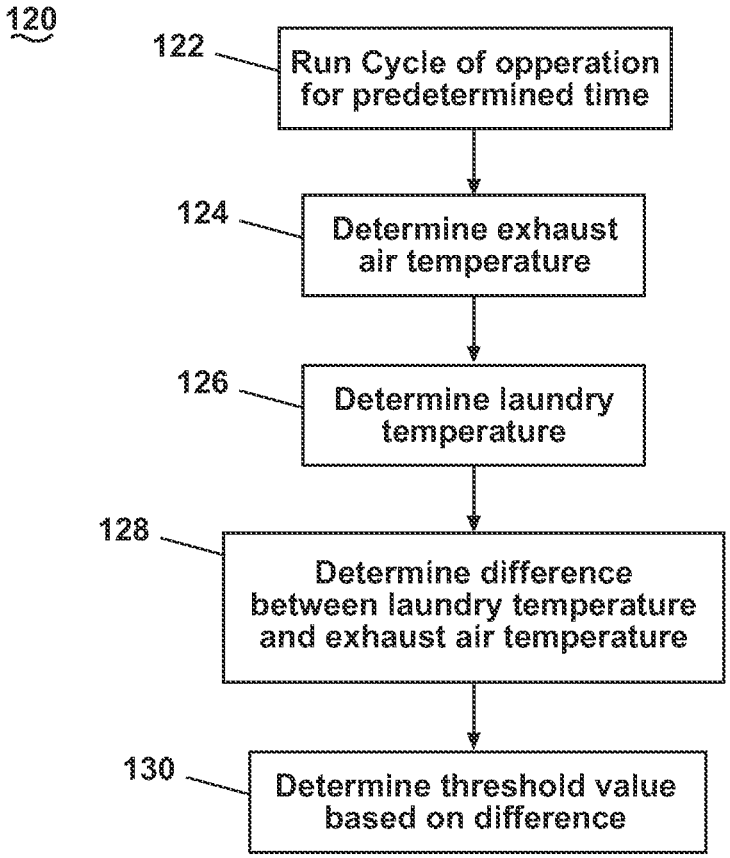
FIG. 6 is a flow diagram to determine the threshold value for the method of determining if a laundry load is dry of FIG. 5.

FIG. 6 shows a flow diagram illustrating a method of determining the threshold value 120 for use in the method of determining if a laundry load is dry 100 of FIG. 5. First, once the cycle of operation is started, it is allowed to run for a predetermined period of time at 122 by the controller 14 to allow the laundry temperature to stabilize. The laundry 36 may be soaked in cold water at the beginning of the drying cycle of operation and prior to the predetermined period of time the laundry may be rapidly heating up and, therefore, the laundry temperature may not have stabilized. The predetermined period of time may be about 5 minutes into the cycle of operation. Next, the exhaust air flow temperature is determined at 124 by the exhaust air temperature sensor 51 and the laundry temperature is determined at 126 by the laundry temperature sensor. The difference between the laundry temperature and the exhaust air temperature is next determined at 128 by the controller 14. The difference is then used to determine the threshold value at 130. The difference may be compared to predetermined limit values. In one implementation, there may be three predetermined limit values corresponding to three different threshold values. In other words, there may be first, second, and third predetermined limit value corresponding to a first, second, and third threshold value for use with method 100 of FIG. 5. For example, the first, second and third predetermined limit values may be 20°, 10°, and 0° F., respectively, corresponding to a first, second, and third threshold value of 0°, 8°, and 15° F., respectively. The first, second, and third threshold values may further correspond to the threshold values for a small, medium, and large laundry load, respectively. Therefore, comparing the difference to predetermined limit values may also provide information on qualitative load size of the laundry 36.

Figure 7:
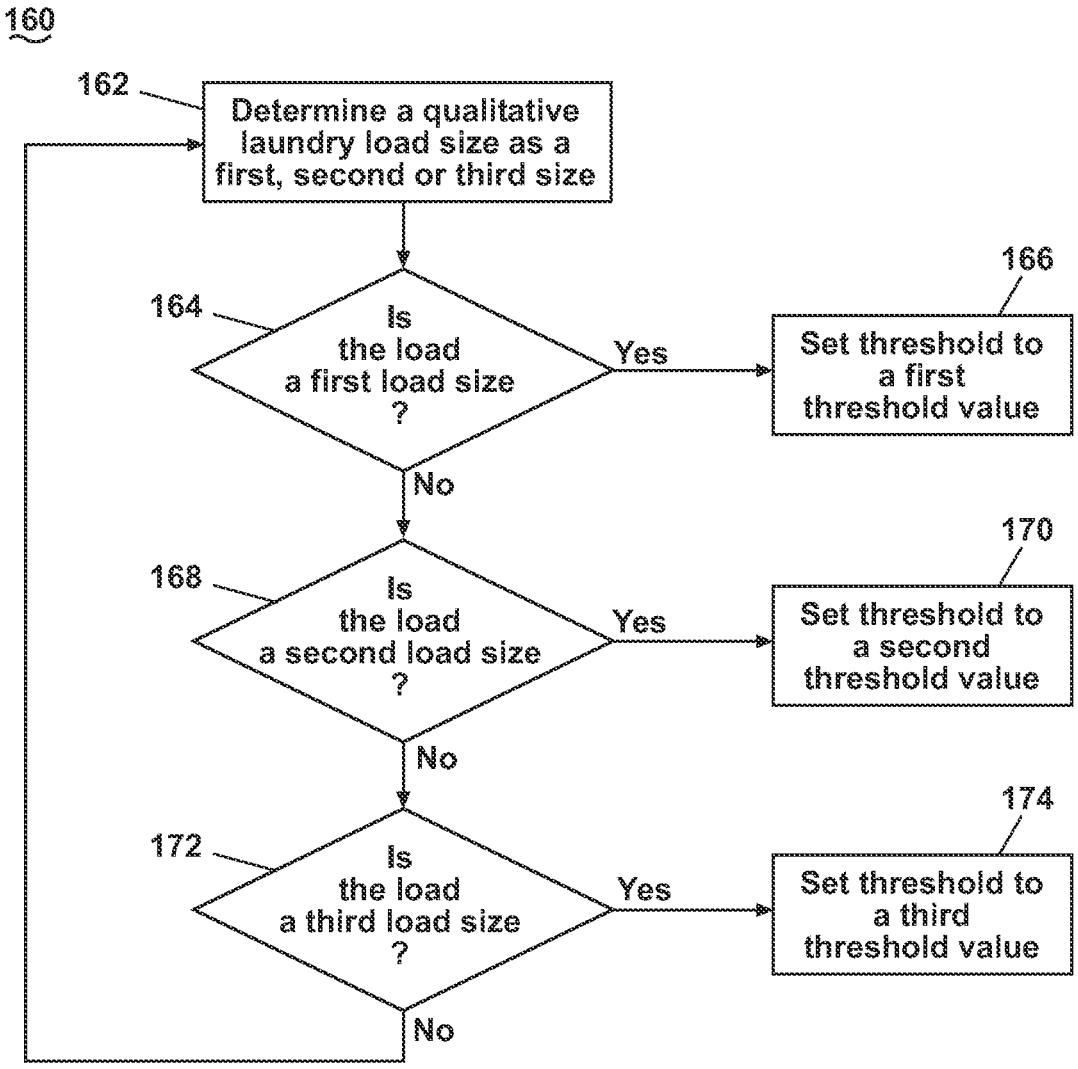
FIG. 7 is a flow diagram illustrating an alternative approach to determine the threshold value for the method of determining if a laundry load is dry of FIG. 5.

FIG. 7 shows a flow diagram illustrating an alternative approach to determining the threshold value 160 for use in the method of determining if a laundry load is dry 100 of FIG. 5 based on determining the load size of the laundry 36 to determine the threshold value. First, a qualitative laundry load size is determined as a first, second, or third size at 162. If the load size is the first load size at 164, then the threshold value is set by the controller 14 at a first threshold value at 166. If the load size is the second load size at 168, then the threshold value is set by the controller 14 at a second threshold value at 170. If the load size is the third load size at 172, then the threshold value is set by the controller 14 at a third threshold value at 174. If a load size was not properly determined then the method loops back to determining a qualitative load size at 162.

The first, second, and third qualitative load sizes may be a small, medium, and large load size, respectively. The first load size may be 3 lbs weight or less, the second load size may be between 3 and 8 lbs., and the third load size may be 8 lbs. or more. For the first load size, the threshold value at 166 may be 0° F., for the second load size the threshold value at 170 may be 8° F., and for the third load size, the threshold value at 174 may be 15° F. Alternatively, the threshold may be the same for all the load sizes. In such a case, the threshold may be 5° F. for all the load sizes.

The load size at 162 may be determined by using known method such as motor torque measurement or load mass estimation (LME) techniques that use supply air temperature as measured by the supply air temperature sensor 47 and exhaust air temperature as measured by the exhaust air temperature sensor 51 near the beginning of the drying cycle, such as during the first two minutes of the drying cycle. Such LME techniques may determine the load size by comparing the slopes of the supply and exhaust air temperatures.

In the method of determining the threshold 160 of FIG. 7 three tiers of load sizes and corresponding threshold values are disclosed. However, there may be any number of tiers of load sizes and corresponding threshold values. For example, there may only be two tiers. In such a two tier method, the two qualitative load sizes may be designated as small and large, with each load size having a corresponding threshold value. As a further example, there may be four tiers. In such a four tier method, the four qualitative load sizes may be extra-small, small, medium and large, with each load size having a corresponding threshold value.

The method disclosed herein for determining when a laundry load is dry to effect an end of the cycle has several advantages compared to prior art methods, such as moisture sensor based methods. The laundry temperature sensor provides useful information about the temperature and thereby the moisture content of the laundry much longer in to the laundry dryer cycle time and at much lower moisture content levels compared to moisture sensor and wet hits based methods. Additionally, the laundry temperature sensor is not prone to EMI as the moisture sensor, resulting in more reliable moisture content data. The use of a laundry temperature sensor may also allow for removing the moisture sensor from the laundry dryer, which may result in cost savings. The use of a laundry temperature sensor may further allow for removing the supply air temperature sensor from the laundry dryer, which may again result in cost savings.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of operating a laundry treating appliance having a rotatable treating chamber for receiving laundry to be dried according to a predetermined cycle of operation, the method comprising:

supplying heated air into the treating chamber;

rotating the treating chamber to tumble the laundry within the treating chamber;

supplying heated air into the treating chamber while the treating chamber is rotated to define a supply air flow;

exhausting the heated air from the treating chamber to define an exhaust air flow;

repeatedly determining over time the temperature of the laundry to define a laundry temperature signal;

repeatedly determining over time the temperature of the exhaust air flow to define an exhaust air temperature signal; and determining the laundry is dry when a difference between the laundry temperature signal and the exhaust air signal satisfies a threshold.

2. The method of claim 1 wherein for a large load, the laundry is determined to be dry when the comparison shows an initial correspondence followed by a divergence between the laundry temperature signal and the exhaust air signal.

3. The method of claim 2 wherein the magnitude of the divergence is indicative of dryness of the laundry.

4. The method of claim 2 wherein during the period of divergence the laundry temperature signal is greater than the exhaust air temperature signal and continues to rise above the exhaust air temperature signal.

5. The method of claim 1 wherein for a small load, the laundry is determined to be dry when the comparison shows an initial convergence followed by a correspondence between the laundry temperature signal and the exhaust air signal.

6. The method of claim 5 wherein the magnitude of the convergence is indicative of dryness of the laundry.

7. The method of claim 5 wherein during the period of convergence the laundry temperature signal is less than the exhaust air temperature signal and rises toward the exhaust air temperature signal.

8. The method of claim 1 wherein for a medium load, the laundry is determined to be dry when the comparison shows an initial convergence followed by a correspondence followed by a divergence between the laundry temperature signal and the exhaust air signal.

9. The method of claim 8 wherein the magnitude of the convergence is indicative of dryness of the laundry.

10. The method of claim 8 wherein the magnitude of the divergence is indicative of dryness of the laundry.

11. The method of claim 8 wherein during the period of convergence the laundry temperature signal is less than the exhaust air temperature signal and rises toward the exhaust air temperature signal.

12. The method of claim 1 wherein for a large load, the laundry temperature signal initially is greater than the exhaust air signal by a first level and subsequently the laundry temperature signal is greater than the exhaust air signal by a second level, wherein the second level is greater than the first level.

13. The method of claim 1 wherein for a small load, the laundry temperature signal initially is less than the exhaust air signal and subsequently the laundry temperature signal is equal to or greater than the exhaust air signal.

14. A method of operating a laundry treating appliance having a rotatable treating chamber for receiving laundry to be dried according to a predetermined cycle of operation, the method comprising:

supplying air into the treating chamber;

heating the air as it is supplied into the treating chamber;

rotating the treating chamber to tumble the laundry within the treating chamber;

supplying heated air into the treating chamber while the treating chamber is rotated to define a supply air flow;

exhausting the heated air from the treating chamber to define an exhaust air flow;

determining the temperature of the laundry to define a laundry temperature;

determining the temperature of the exhaust air flow to define an exhaust air temperature;

determining a difference between the laundry temperature and the exhaust air temperature;

comparing the difference to a threshold; and determining the laundry is dry when the difference satisfies the threshold.

15. The method of claim 1 wherein the comparing the difference comprises comparing an absolute value of the difference to the threshold.

16. The method of claim 1 wherein the difference satisfying the threshold comprises at least one of the difference being equal to, less than, and greater than the threshold.

17. The method of claim 1 further comprising ceasing the heating of the air when the difference satisfies the threshold.

18. The method of claim 17 further comprising continuing the rotating of the treating chamber and supplying of air to cool the laundry.

19. The method of claim 1 further comprising determining a remaining cycle time and displaying the remaining cycle time.

20. The method of claim 1 further comprising determining the threshold based on load size of the laundry.

21. The method of claim 1 wherein when the laundry is a large load, the threshold is satisfied when the difference is greater than 15 degrees F.

22. The method of claim 1 wherein when the laundry is a medium load, the threshold is satisfied when the difference is greater than 8 degrees F.

23. The method of claim 1 wherein when the laundry is a small load, the threshold is satisfied when the difference is greater than 0 degrees F.

24. The method of claim 1 further comprising determining the threshold based on the difference between the laundry temperature and exhaust air temperature after a predetermined time threshold.

25. The method of claim 1 further comprising determining a qualitative load size based on the difference between the laundry temperature and exhaust air temperature after a predetermined time threshold.

26. The method of claim 1 wherein the temperature of the laundry is determined with an infrared (IR) sensor provided within the treating chamber.

27. The method of claim 1 wherein determining the difference comprises determining a filtering or smoothing of the difference over a temporal window.

* * * * *